US005608976A

United States Patent [19]

Marega et al.

[11] Patent Number: 5,608,976

[45] Date of Patent: Mar. 11, 1997

[54] INNER SHOE FOR SKI-BOOTS

[75] Inventors: Antonello Marega; Mario Sartor, both of Volpago, Italy

[73] Assignee: Tecnica Spa, Treviso, Italy

[21] Appl. No.: 353,334

[22] Filed: Dec. 5, 1994

[30] Foreign Application Priority Data

Dec. 7, 1993 [IT] Italy ..... TV93A0111

[51] Int. Cl.[6] ..... A43B 23/07

[52] U.S. Cl. ..... 36/10; 36/55; 36/117.6

[58] Field of Search ..... 36/10, 119, 55, 36/54, 93, 117.6

[56] References Cited

U.S. PATENT DOCUMENTS

| | | | |
|---|---|---|---|
| 3,581,412 | 6/1971 | Dalebout | 36/119 |
| 3,685,176 | 8/1972 | Rudy | 36/93 X |
| 3,758,964 | 9/1973 | Nishimura | 36/119 |
| 4,154,009 | 5/1979 | Kubelka et al. | 36/119 |
| 4,428,130 | 1/1984 | Perotto | 36/10 X |
| 4,499,675 | 2/1985 | Perotto | 36/10 X |
| 4,790,082 | 12/1988 | Pozzebon | 36/10 X |
| 4,893,417 | 1/1990 | Dalla Lana | 36/10 |
| 4,920,666 | 5/1990 | Marega | 36/10 X |
| 5,279,053 | 1/1994 | Pallatin et al. | 36/10 X |

FOREIGN PATENT DOCUMENTS

| | | | |
|---|---|---|---|
| 0084788 | 8/1983 | European Pat. Off. . | |
| 0107841 | 5/1984 | European Pat. Off. . | |
| 0120267 | 10/1984 | European Pat. Off. . | |
| 0308368 | 3/1989 | European Pat. Off. . | |
| 0351396 | 1/1990 | European Pat. Off. . | |
| 0364400 | 4/1990 | European Pat. Off. . | |
| 0536519 | 4/1993 | European Pat. Off. . | |
| 2136161 | 12/1972 | France . | |
| 2230155 | 1/1975 | France | 36/119 |
| 2475864 | 8/1981 | France | 36/54 |
| 2694682 | 2/1994 | France . | |
| 3429284 | 2/1986 | Germany | 36/119 |
| 0213923 | 6/1967 | Sweden | 36/54 |
| 481593 | 1/1970 | Switzerland . | |

*Primary Examiner*—Ted Kavanaugh
*Attorney, Agent, or Firm*—Griffin, Butler, Whisenhunt & Kurtossy

[57] ABSTRACT

In an inner shoe (10) for ski-boots comprising a sole (18) and an upper (16) which includes a padding (24) enclosed in an inner (26) and outer (28) lining, the shoe (10) is of the rear-entry type whereby it has a rear opening (20) extending from the top end (22) of the upper (16) up to the sole area and the shoe has not the usual front opening which can be covered by a tongue.

19 Claims, 8 Drawing Sheets

INNER SHOE FOR SKI-BOOTS

The present invention relates to an inner shoe for ski-boots of the type comprising a sole and an upper which includes a padding enclosed in a inner and outer lining.

BACKGROUND OF THE INVENTION

The shoe type of the present invention must meet two requirements which are partially opposite each other and also related to the features and type of the outer casing (shell and boot leg) of the ski-boot. The shoe must allow an easy entry of the foot.

The shoe must wrap the foot as tightly as possible so as to transmit with the greatest possible accuracy the movements which start from the skier's leg and foot and which through the shoe and casing reach the ski.

The shoe must maintain the comfort degree necessary to make the sports activity more pleasant.

The shoes made until now are of two types, namely of the front and rear-entry type. In the first case, the front-entry shoe has a front opening with flaps which can be opened wide apart and this opening can be closed by a tongue provided underneath.

In this well-known embodiment, although elastic and/or padded insertng members have been utilized, the shoe with a front-entry shell may be put on with difficulty.

In the second case, the rear-entry shoe has an opening, for the entry of the foot, extending from the heel portion up to the top of the shin and closed on the rear part by a padded spoiler extending from the heel area up to the front part below the calf. In this way it is easy to put on the shoe but it is impossible to change the volume of the shoe at the front part during the tightening of the boot by the fastening mechanisms.

Another problem of the rear-entry shoe lies in the fact that the shoe tends to come out from the shell when the foot is removed.

The aim of the present invention is then to prtovide an inner shoe for ski-boots which solves the above-mentioned problems and provide advantages, and in particular, allows an easy entry of the foot and has an high degree of flexibility so as to overcome the drawbacks explained with reference to the cited prior art and to prevent the removal of the shoe when the foot is removed from the ski-boot.

SUMMARY OF THE INVENTION

This aim is reached by an inner shoe of the indicated type characterized in that said shoe is of the rear-entry type whereby it has at the back an opening extending from the top end of the upper to near the sole. Furthermore, in the preferred embodiment of the present invention, the padding and one of the linings have at least one slit whereas the other lining is elastic and the slit is made at the portion corresponding to the instep.

With reference to the preferred embodiment of the invention again, a strap is attached to the ski-boot at the rear opening of the shoe, said strap projecting upwards and being elastically stressed towards the inside of the shell so as to engage the shoe hindering the removal of the shoe from the shell, said strap being able to bend elastically outwards so as to release said shoe, A first advantage of the shoe according to this invention lies in the fact that during the critical moment, wherein the foot is put into the shoe until the heel reaches its housing seat formed in the shoe, the latter loses its shape at the portion corresponding to the instep facilitating the entry of the foot.

In fact, the slits made in the upper allow the shoe to lose its shape above all at the portion corresponding to the instep.

Another advantage is achieved owing to the capability of the shoe to lose its shape easily during the tightening of the ski-boot whereby the shoe does not hinder the reduction of volume caused by the tightening operation but, on the contrary, the shoe fits to the final shape of the ski-boot allowing a better transmission of movements of the leg to the ski.

Another advantage derives from the fact that the shoe follows also exactly the strains which occurs in the ski-boot during the skiing activity making the latter more comfortable.

Another advantage further results from the elastic strap for locking the shoe which may be released and then easily removed by a simple outward bending of the strap namely in the direction that moves the same away from the adjacent surface of the shoe.

According to a particular embodiment of the invention, the shoe has slits or side portions of reduced thickness on the upper which increase the flexibility thereof and accordingly the above-mentioned advantages.

BRIEF DESCRIPTION OF THE DRAWINGS

The invention will be illustrated with reference to the enclosed drawings which illustrate an embodiment given as a non-limiting example. In the drawings.

DETAILED DESCRIPTION OF PREFERRED EMBODIMENTS

Figure 1:
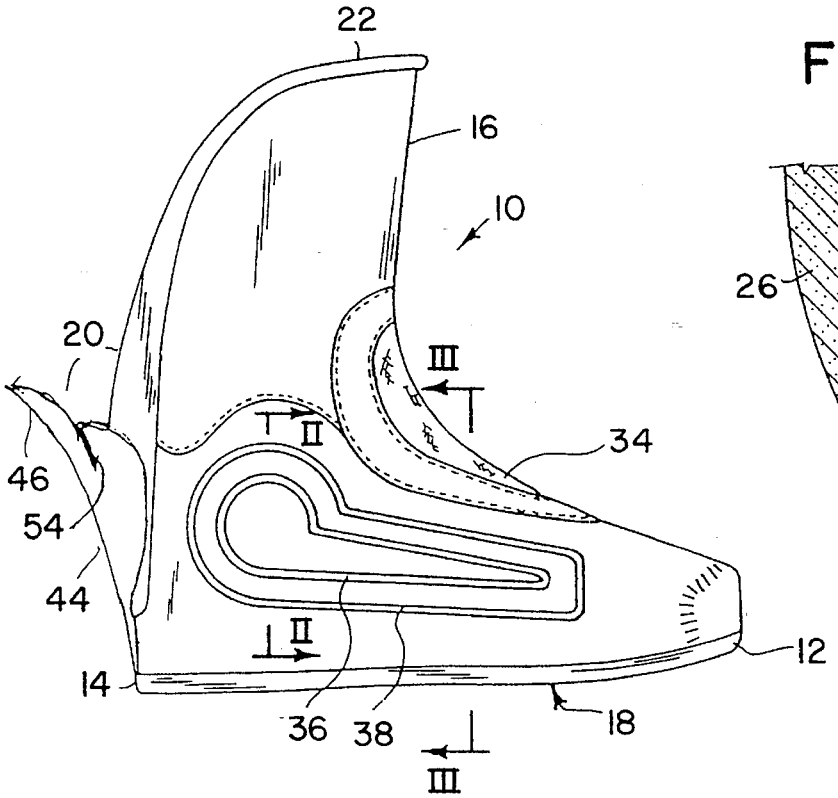
FIG. 1 is a longitudinal view of a rear-entry inner shoe according to the invention.

FIG. 1 shows an inner shoe for ski-boots, indicated by reference 10 on the whole, having a toe portion 12 and a heel portion 14, longitudinally opposite each other. The inner shoe 10, comprising an upper 16 and a sole 18, is of the rear-entry type whereby it has a rear opening 20 perpendicular to the sole 18 and extending from the top end 22 of the upper 16 to near the sole 18.

Figure 3:
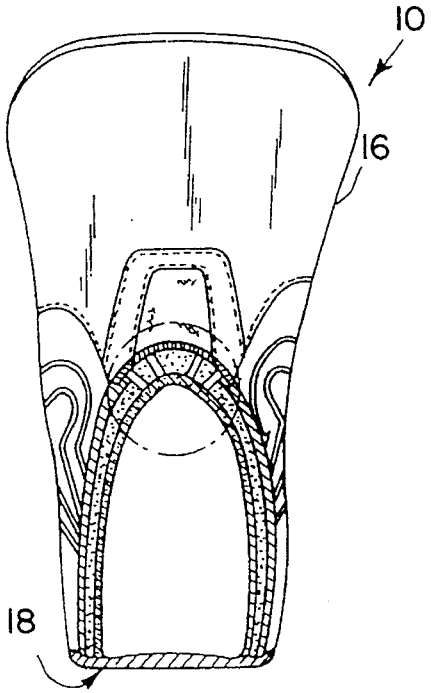
FIG. 3 is a cross-section along plane III—III of FIG. 1.
Figure 4:
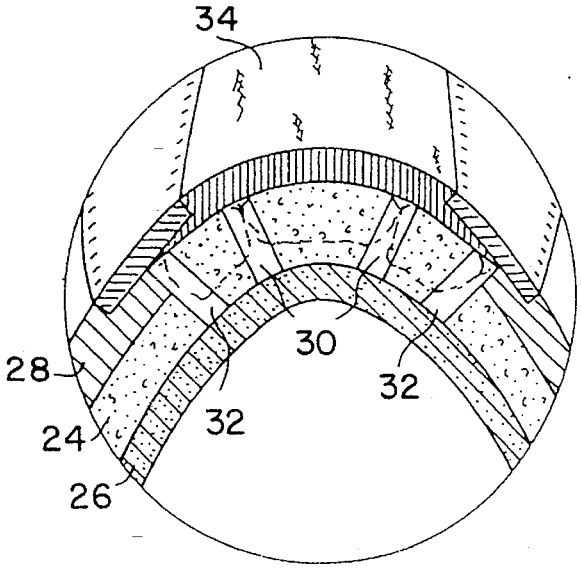
FIG. 4 is an enlarged view of a particular of FIG. 3.

In particular, as can be seen from FIGS. 3 and 4, in order to make more comfortable the fit of the shoe, the upper 16 comprises a padding 24 enclosed between two linings: an elastic inner one and a protective outer one respectively indicated by references 26 and 28. The padding 24 has two front slits symmetrically arranged with respect to the middle plane of the shoe, at the area corresponding to the instep, the slits are made in the padding and radially arranged with respect to the camber of the surface of the adjacent foot; references 30 and 32 indicate the inner and the outer slits respectively.

Furthermore the padding 24 is not provided with the elastic outer lining in the rectangular area comprised between the two outer slits 32 and, in order to cover this area, an elastic covering 34 is provided.

Figure 2:
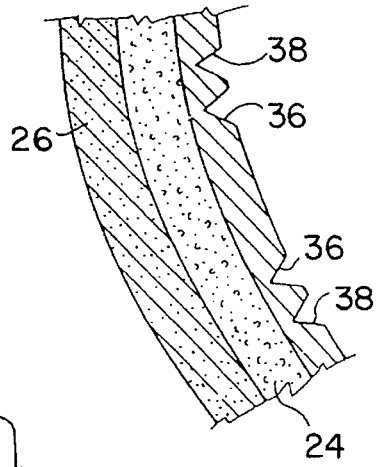
FIG. 2 is a partial cross-section of FIG. 1 taken along plane II—II of FIG. 1.

Finally, as can be seen from FIGS. 1 and 2, the inner shoe, at the portion corresponding to the ankle, has two slits 36 and 38 on both sides with respect to the longitudinal plane of the ski-boot, the slits, made in the protective outer lining 28, are substantially circular, concentric with each other and extending towards the toe portion 12.

It is evident that the rear opening 20 allows the entry of the foot into the shoe 10, the entry being facilitated because the front slits 30,32 and side slits 36,38 of the shoe increase its flexibility allowing the shoe to lose its shape easily and to house the foot in a more comfortable way. Moreover, having the shoe with a high degree of flexibility, it easily adapts to the deformations of the ski-boot which occur during the tightening thereof and the skiing activity allowing a good transmission of movements from the leg to the ski and a considerably comfort for the foot.

Figure 5:
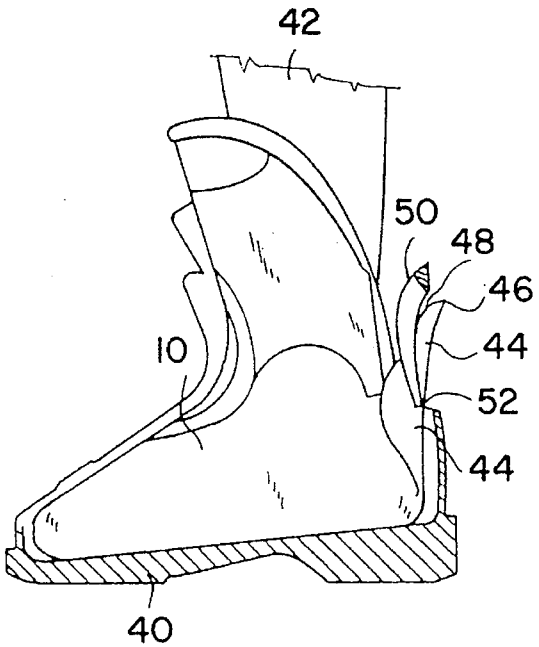
FIG. 5 is a partially cross-sectioned schematic view of the ski-boot shell and of the shoe elastically anchored to the shell, with a foot therein.

In FIG. 5 the shoe 10 of FIG. 1 is shown inserted inside the shell 40 (which is shown by a partial and very schematic cross-section) of the ski-boot whereas reference 42 indicates the skier's foot.

The rear opening 20 of the shoe is defined, towards the heel portion, by a tongue 44 (clearly visible also in FIG. 1) and, in particular, the tongue ends with an edge 46 joined to the body of the tongue by a curved portion 48.

Furthermore, the shell has a strap 50 which is approximately shaped as a bridge or semi-slot, the ends of which are anchored at 52 to the two adjacent sides of the shell.

The strap 50 is of plastic material having points of connection to the shell allowing considerable elasticity and flexibility.

Figure 6:
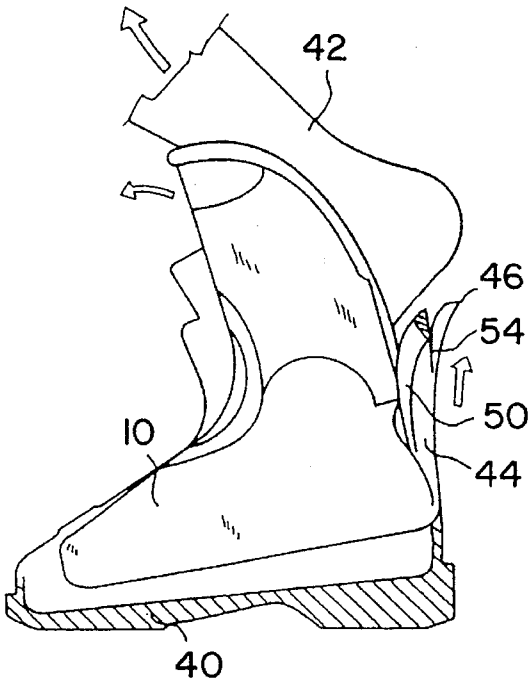

As it clearly appears from FIG. 5, when the shoe 10 is put into the shell 40, the tongue 44 engages the strap 50 so that the edge 46 crosses (owing to the intrinsic elasticity) the opening formed by the strap thus locking the shoe to the shell. Preferably, in the body of the tongue 44 a slit 54 is formed, for example formed and reinforced by seams and quilting operations, the function of which is to ensure that the shoe remains in the shell when the foot is removed from the ski-boot. This situation is better illustrated in FIG. 6 from which it can be appreciated that during the removal of the foot 42, the shoe 10 rises to the extent which is permitted by the depth of the slit 54 facilitating still further the removal of the foot from the shell and boot leg (not shown).

Figure 7:
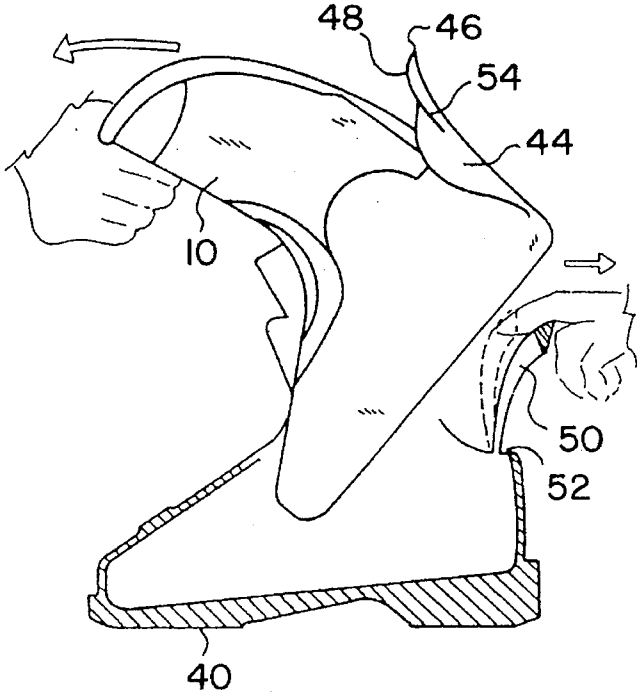
FIGS. 6 and 7 are views similar to FIG. 5 which show two successive positions illustrating, respectively, the removal of the foot and shoe from the shell.

When the removal of the shoe 10 from the shell 40 is required, it is sufficient (as represented in FIG. 7) to operate the strap 50 bending it elastically outwards to such an extent that the strap overlaps the edge 46 of the tongue 44 whereby the shoe 10 may be easily removed from the shell 40.

Figure 8:
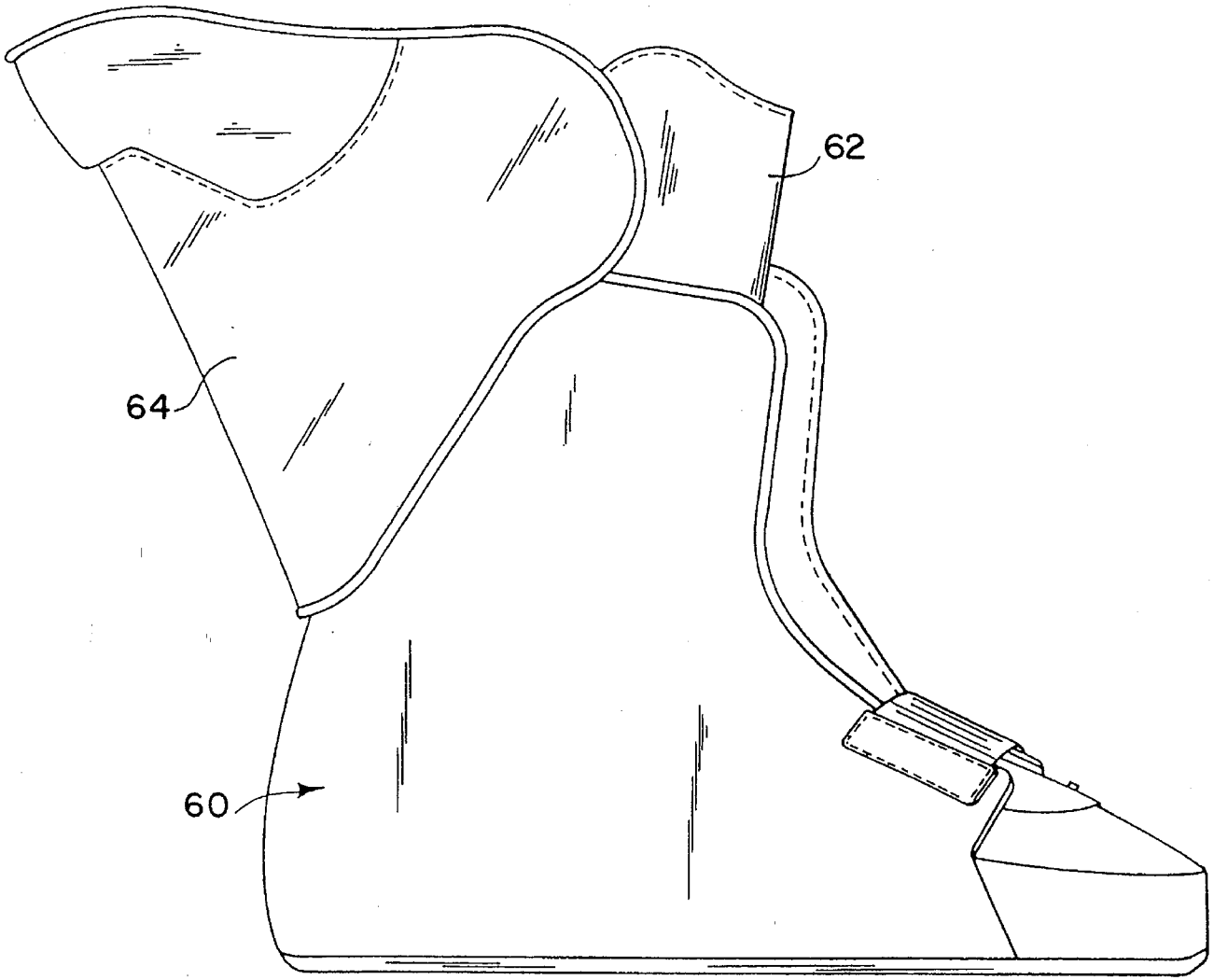
FIG. 8 is a schematic side view of a first modified embodiment of an inner shoe according to this invention.

A standard shoe 60 is schematically shown in FIG. 8 wherein the present invention has been used, a shoe which is provided with a front tongue 62 and which may be of the type described in Italian patent No. 1.223.382 and in patent application for industrial invention No. 20546 A/90 of the same applicant.

In this case the shoe 60 has a body or upper lowered in its rear part, namely having the same shape of the shoe 10 of FIG. 1 or FIG. 5, whereas reference 64 indicates a padded spoiler which is integral to the boot leg and the sides of the spoiler are obviously hinged to the two sides of the ski-boot shell. In FIG. 8 said spoiler is shown in the situation wherein the boot leg is opened for the entry or the pulling out of the foot. It is important to note that the spoiler 64 is completely independent with respect to the shoe 60; therefore, the advantages of the standard front-entry shoes are kept and at the same time the advantages of the shoe of the present invention are added.

Figure 10:
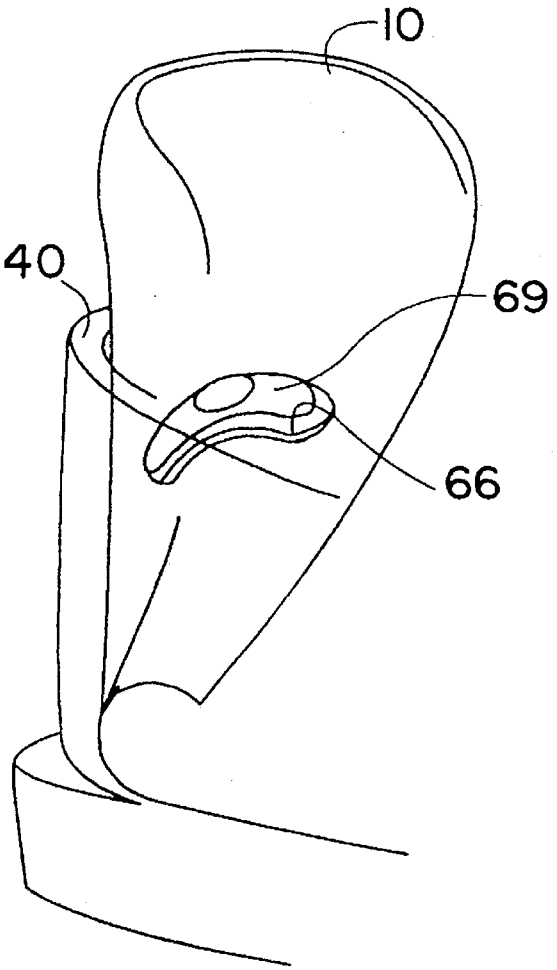
FIGS. 9 and 10 are schematic partial views of an inner shoe according to a second modified embodiment, the shoe being represented as anchored to and released from the shell respectively.
Figure 9:
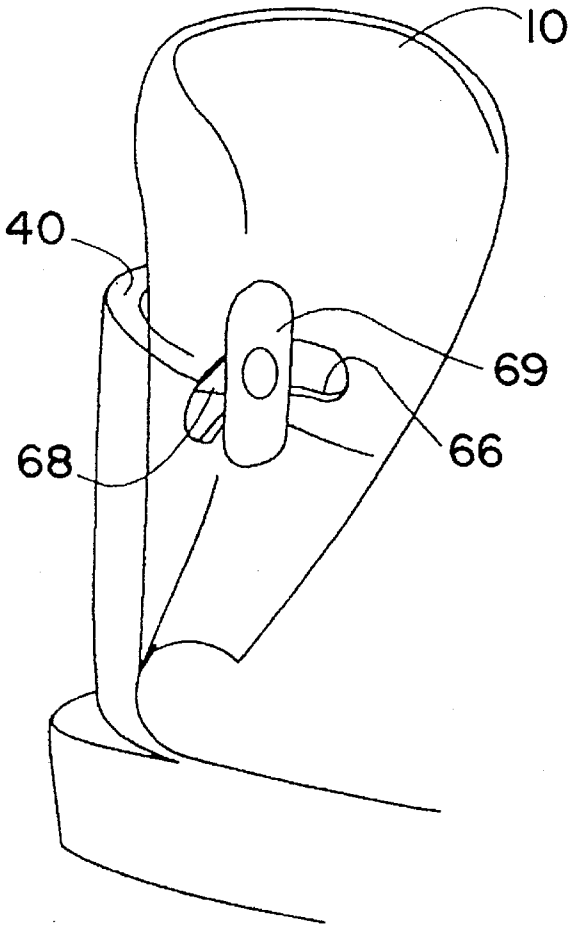

FIGS. 9 and 10 show an inner shoe 10 in which a horizontal slot 66 is formed in the rear part of the shoe whereas the shell 40, on the opposite side, is provided with a projecting pin 68 engaging in the slot 66. The end of the pin 68 is provided with a rotating arm 69 which hinders the removal of the inner shoe 10 from the shell 40 when it is vertically arranged (FIG. 9) whereas it allows the removal of the inner shoe when it is horizontally arranged (FIG. 10).

Figure 12:
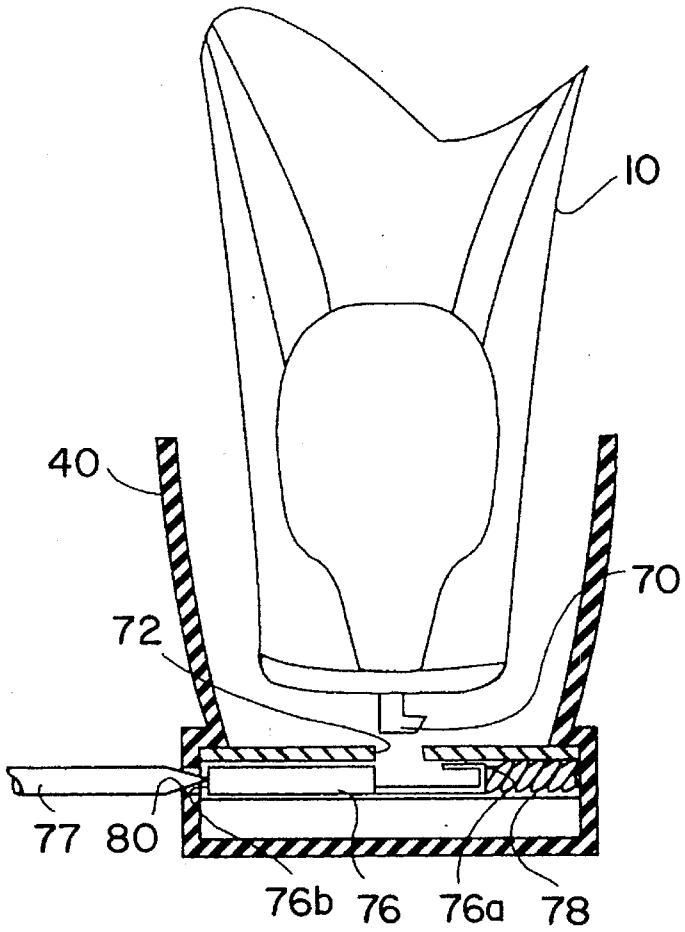
FIGS. 11 and 12 are schematic front sections of an inner shoe according to a third modified embodiment, the shoe being represented as anchored to and released from the shell respectively.
Figure 11:
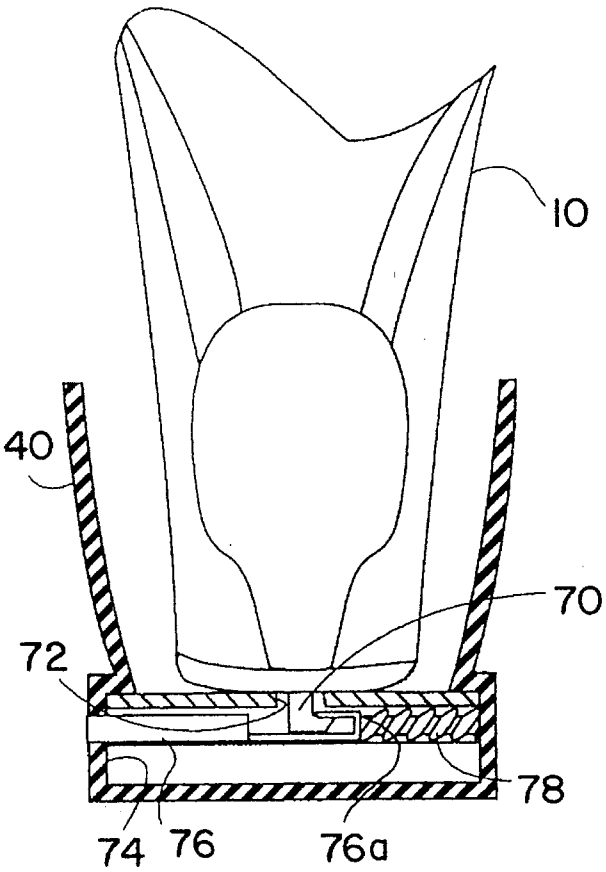

FIGS. 11 and 12 show an inner shoe 10 provided with a hook 70 on its lower part and this hook is suitable to be inserted, through an opening 72 made in the bottom of the shell 40, into a housing or seating 74 formed below the bottom of the shell 40. Inside the seating 74 is slidable housed a member 76 having a first hook-shaped end **76*a* suitable for hooking the hook 70 of the inner shoe 10. A spring 78 is interposed between the hook-shaped end 76*a* of the member 76 and the wall of seating 74 facing the member 76 and this spring has the function of maintaining the member 76 engaged with the hook 70 of the inner shoe 10, as illustrated in FIG. 11**.

If the removal of the inner shoe 10 from the shell 40 is required, it is sufficient to push the member 76, by a tool 77 inserted through an opening 80 made in the portion of the shell 40 facing the second end **76*b* of the member 76, overcoming the resistance of the spring 78 (FIG. 12). In such a way the hook-shaped end 76*a* of the member 76 is released from the hook 70 of the inner shoe 10 permitting the removal of the inner shoe 10 from the shell 40**.

Figure 14:
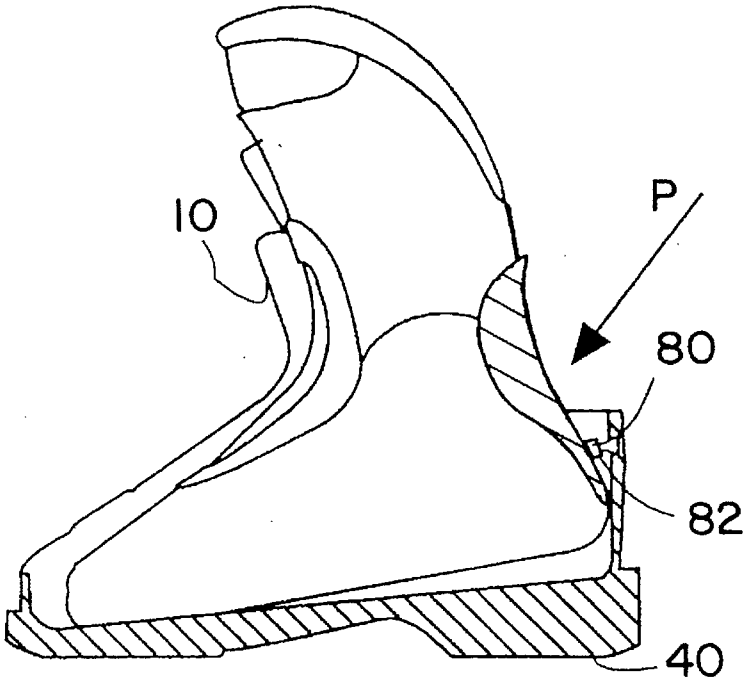
FIGS. 13 and 14 are schematic side sections of an inner shoe according to a fourth modified embodiment, the shoe being represented as anchored to and released from the shell respectively.
Figure 13:
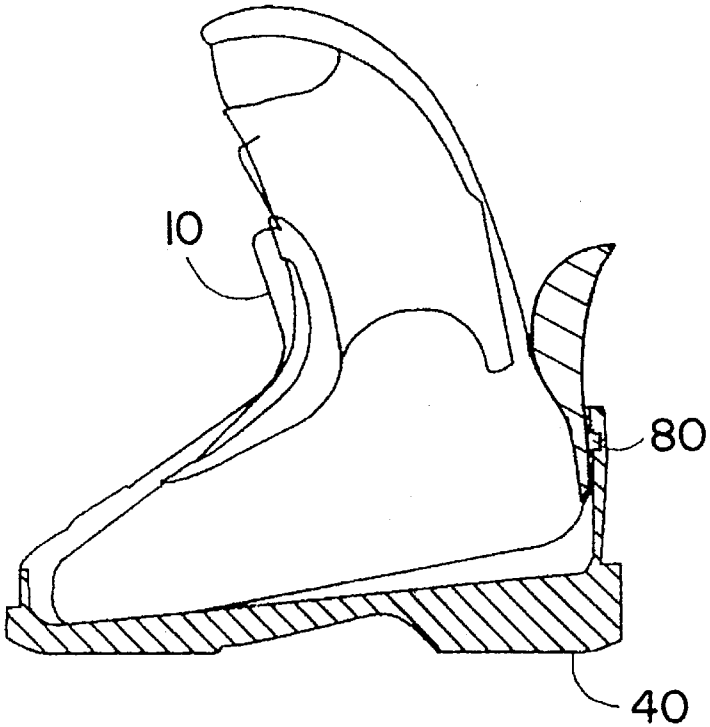

FIGS. 13 and 14 illustrates an inner shoe 10 provided with a rear protrusion 80 suitable to engage into a cavity 82 formed inside the shell 40. In order to released the inner shoe 10, beginning from the position wherein the same is engaged with to the shell 40 (FIG. 13), it is sufficient to push on the rear part of the inner shoe, as indicated by arrow P in FIG. 14, withdrawing the protrusion 80 from the cavity 82 and, finally, to remove the inner shoe 10 from the shell 40.

Figure 16:
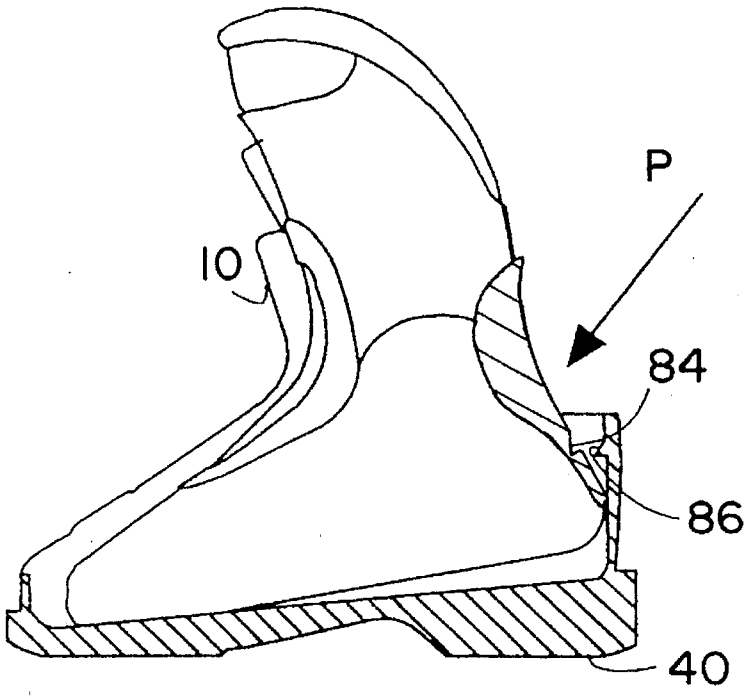
FIGS. 15 and 16 are schematic side sections of an inner shoe according to a fifth modified embodiment, the shoe being represented as anchored to and released from the shell respectively.
Figure 15:
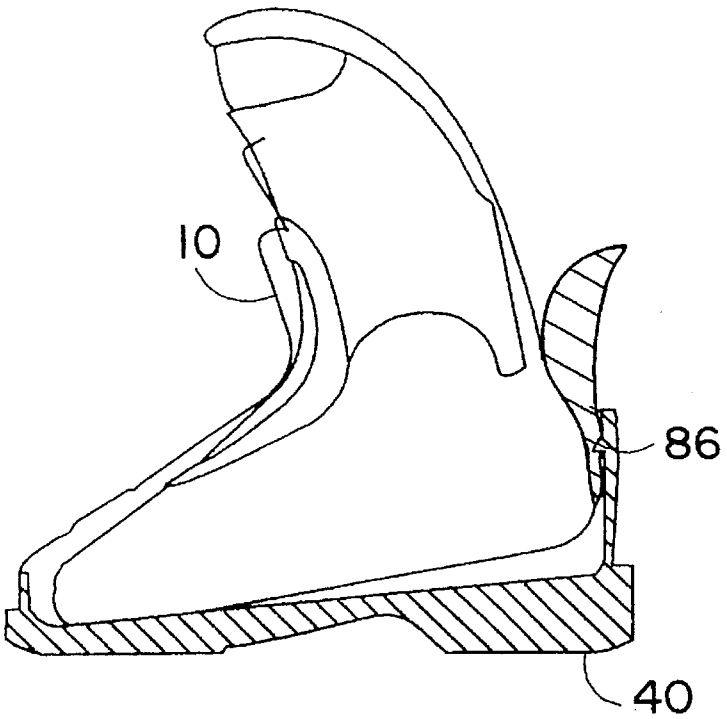

FIGS. 15 and 16 illustrate an inner shoe similar to the one illustrated in FIGS. 13 and 14 respectively wherein the inner shoe 10 has a cavity 84 whereas the shell 40 is provided with a corresponding protrusion 86.

Figure 18:
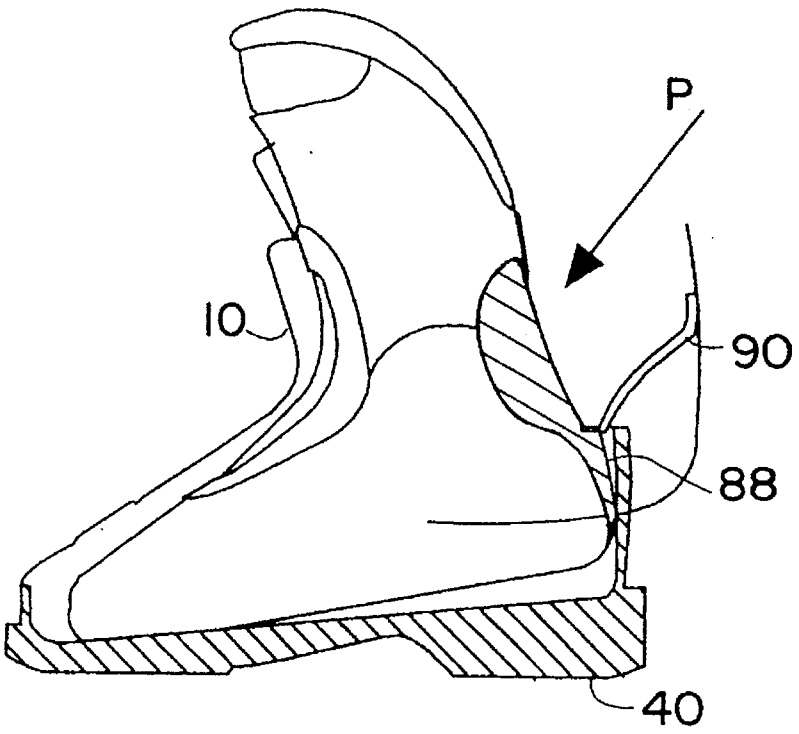
FIGS. 17 and 18 are schematic side sections of an inner shoe according to a sixth modified embodiment, the shoe being represented as anchored to and released from the shell respectively.
Figure 17:
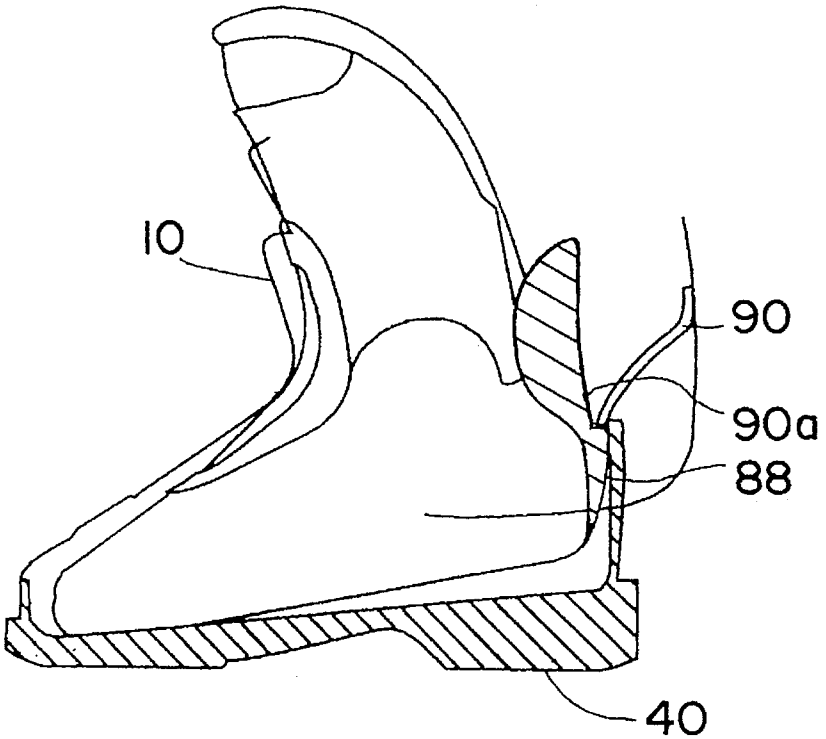

FIGS. 17 and 18 illustrate an inner shoe 10 having an outer rear profile forming a step 88 which is suitable for being engaged, on its upper part, with the end 90*a* of a tongue 90 projecting from the shell 40 (FIG. 17).

In order to remove the inner shoe from the shell 40, it is necessary to press onto the tongue 90 (see arrow P of FIG. 18) or on the rear part of the inner shoe 10 thus releasing the end 90*a* of the tongue 90 from the step-shaped profile of the inner shoe 10.

We claim:

1. In an inner shoe (10) for being placed inside a rigid shell of a ski-boot, said inner shoe comprising a sole (18) and an upper (16) which includes a padding (24) enclosed between an inner lining (26) and outer lining (28), the improvement wherein the inner shoe (10) is of a rear-entry type having a rear opening (20) extending perpendicular to the sole (18) starting from a top end (22) of the upper (16) and extending toward a sole area, said padding (24) having at least one slit (30,32) formed at a front part of the inner shoe at an area corresponding to a wearer's instep and at least one of the inner and outer linings (26,28) being elastic with said elastic of said at least one of the inner and outer lining spanning an otherwise open edge of said at least one slit so as to extend across the edge the slit to thereby cover the edge of the slit.

2. Inner shoe according to claim 1, wherein said slit extends completely through said padding and wherein there is a gap in the other of said inner and outer linings at an opposite edge of said slit in the padding, there being a separate elastic inserting member (34) to cover said opposite edge of said at least one slit (30,32) in said gap.

3. Inner shoe according to claim 2, wherein said inner lining (26) is said at least one lining which is elastic and is disposed on the inside of the inner shoe and the outer lining (28) is said other of said inner and outer linings disposed at an outer portion of the inner shoe.

4. Inner shoe according to claim 3, wherein on each of two side portions of the outer lining (28), with respect to a longitudinal plane of the shoe, at least one lateral slit (36,38) is disposed in the outer lining (28).

5. Inner shoe according to claim 4, wherein each of said at least one lateral slit (36,38) has an elongated loop shape, the elongation extending lengthwise of the inner shoe towards a toe area (12) of the inner shoe (10).

6. Inner shoe according to claim 5, wherein there are two lateral slits (36,38) formed in loops on each of said two side portions of the outer lining (28), with one loop surrounding the other.

7. Inner shoe according to claim 1, wherein said at least one front slit (30,32) has a substantially rectangular shape in cross section, having longer sides arranged substantially perpendicular to the inner and outer linings.

8. Inner shoe according to claim 1, wherein there are two slits (30,32) arranged on each of opposite sides of a longitudinal center plane of the inner shoe and wherein said slits extend completely through said padding and wherein there is a gap in the other of said inner and outer linings at opposite edges of said slits in the paddings, there being a separate elastic inserting member (34) which extends between outermost slits (32) on opposite sides of the longitudinal center plane in said gap.

9. Inner shoe according to claim 1, wherein the rear opening (20) is defined by a tongue (44) for engaging a bridge shaped strap (50) having the ends thereof anchored to two sides of the ski-boot shell.

10. Inner shoe according to claim 9, wherein said tongue (44) has a slit (54) suitable for engaging said bridge strap (50) when said inner shoe is moved upwardly with respect to an inner bottom of the ski-boot shell.

11. Inner shoe according to claim 1, wherein the inner shoe has a front covered by a front tongue.

12. Inner shoe according to claim 11, wherein an upper edge of the upper of the inner shoe is lower than an upper edge of the front tongue and a front part of padding (64) covering the rear opening (20) includes a means for being supported by a spoiler integral with a boot leg of the ski-boot.

13. Inner shoe according to claim 1, wherein releasable restraining means are provided for engaging the shell and thereby preventing the removal of the inner shoe from the shell when the restraining means is engaged and for allowing removal of the inner shoe from the shell when the restraining means is disengaged.

14. Inner shoe according to claim 13, wherein the inner shoe has a horizontal slot (66) for being engaged by a projecting pin (68) provided on the shell (40) of the ski-boot.

15. Inner shoe according to claim 14, wherein is further included a means for engaging a rotating arm (69) provided at an end of said projecting pin (68) so that, when the arm (69) is arranged parallel to the slot (66), the removal of the inner shoe (10) from the shell of the ski boot is allowed and, when the arm (69) is differently arranged, the removal of the inner shoe (10) from the shell (40) is prevented.

16. Inner shoe according to claim 13, wherein the inner shoe is provided with hook (70) on a lower part thereof, the hook for being inserted through an opening in a bottom of the shell (40), in a seat (74) formed below the bottom of the shell (40) and for engaging a hook-shaped end (76*a*) of a member (76) which is slidably housed in the seat (74).

17. Inner shoe according to 13, wherein the inner shoe is provided with a rear protrusion (80) for engaging a cavity (82) formed inside the shell (40).

18. Inner shoe according to claim 13, wherein the inner shoe is provided with rear cavity (84) for engaging a corresponding protrusion (86) formed in the shell (40).

19. Inner shoe according to claim 13, wherein an outer rear profile of the inner shoe forms a step (88) for engaging, on an upper part thereof, with an end (90*a*) of a tongue (90) projecting from the shell (40).

* * * * *